United States Patent [19]

Faust

[11] 4,249,726

[45] Feb. 10, 1981

[54] EXERCISE BENCH SAFETY DEVICE

[76] Inventor: Reginald O. Faust, 41 Oak Ct., Annapolis, Md. 21401

[21] Appl. No.: 41,504

[22] Filed: May 22, 1979

[51] Int. Cl.[3] ..... A63B 13/00

[52] U.S. Cl. ..... 272/123; 272/117; 272/144

[58] Field of Search ..... 272/93, 103, 109, 116, 272/117, 118, 122, 123, 134, 144; 128/25 R

[56] References Cited

U.S. PATENT DOCUMENTS

| | | | |
|---|---|---|---|
| 3,003,765 | 10/1961 | Dove | 272/117 |
| 3,235,255 | 2/1966 | Leflar | 272/123 |
| 3,346,256 | 10/1967 | White | 272/123 X |
| 3,637,204 | 1/1972 | Dawson | 272/103 |
| 3,918,710 | 11/1975 | Niebojewski | 272/117 |
| 3,948,513 | 4/1976 | Pfotenhauer | 272/144 |

FOREIGN PATENT DOCUMENTS

| | | | |
|---|---|---|---|
| 456790 | 3/1928 | Fed. Rep. of Germany | 272/123 |
| 2328486 | 5/1977 | France | 272/118 |

*Primary Examiner*—Richard J. Apley

*Attorney, Agent, or Firm*—Scrivener, Clarke, Scrivener and Johnson

[57] ABSTRACT

A safety device for use in conjunction with bench press exercises is disclosed wherein a pair of arms controllable by the exerciser may be elevated into engagement with a bar bell to raise it clear of the exerciser before it can seriously injure him should he be unable, due to fatigue, to raise the bar bell to its normal support pegs above the bench. The elevating mechanism may be a power operated jack or counter weights normally controlled by a jack.

8 Claims, 8 Drawing Figures

EXERCISE BENCH SAFETY DEVICE

This invention relates to exercise benches and more particularly to safety devices for use inconjunction with bench press exercising.

In bench pressing, an exerciser lies on his back on a bench with his feet on the floor and raises and lowers over his chest a bar bell consisting of a bar having at its ends balanced changeable weights which may have a combined weight in excess of 500 pounds.

Prior to exercising, the bar bell is positioned on pegs carried by vertical frame members on either side of the forward end of the bench, the pegs being disposed in an elevated position approximately matching the extended length of the exerciser's arms. After the exerciser has positioned himself on his back on the bench beneath the bar bell, he grips the bar bell, lifts it off the pegs, brings it slightly rearwardly to clear the pegs and does his exercises. At the completion of these, the exerciser elevates the bar bell one last time, moves it slightly forwardly and then lowers it onto the pegs after which the exerciser is free to leave the bench beneath the supported bar bell.

As those in the exercising field are well aware, it is extremely dangerous to ever bench press with heavy weights by oneself because of the danger that the exerciser may have over-extended himself and be unable to raise the bar bell the one last time to engage it with the elevated support pegs. Should this happen the exerciser must ask for the assistance of others nearby to lift the weight from him lest it settle on his chest and crush him, which would likely happen due to concentration of the weight on the exerciser's chest over the relatively small area of that portion of the bar contacting the chest.

The object of the present invention is to eliminate the problems and dangers associated with bench pressing by providing means readily controlled by a bench presser for elevating a bar bell clear of the exerciser's chest independently of any lifting effort by the exerciser.

The invention will now be described in detail with reference to the accompanying drawings wherein.

Figure 1:
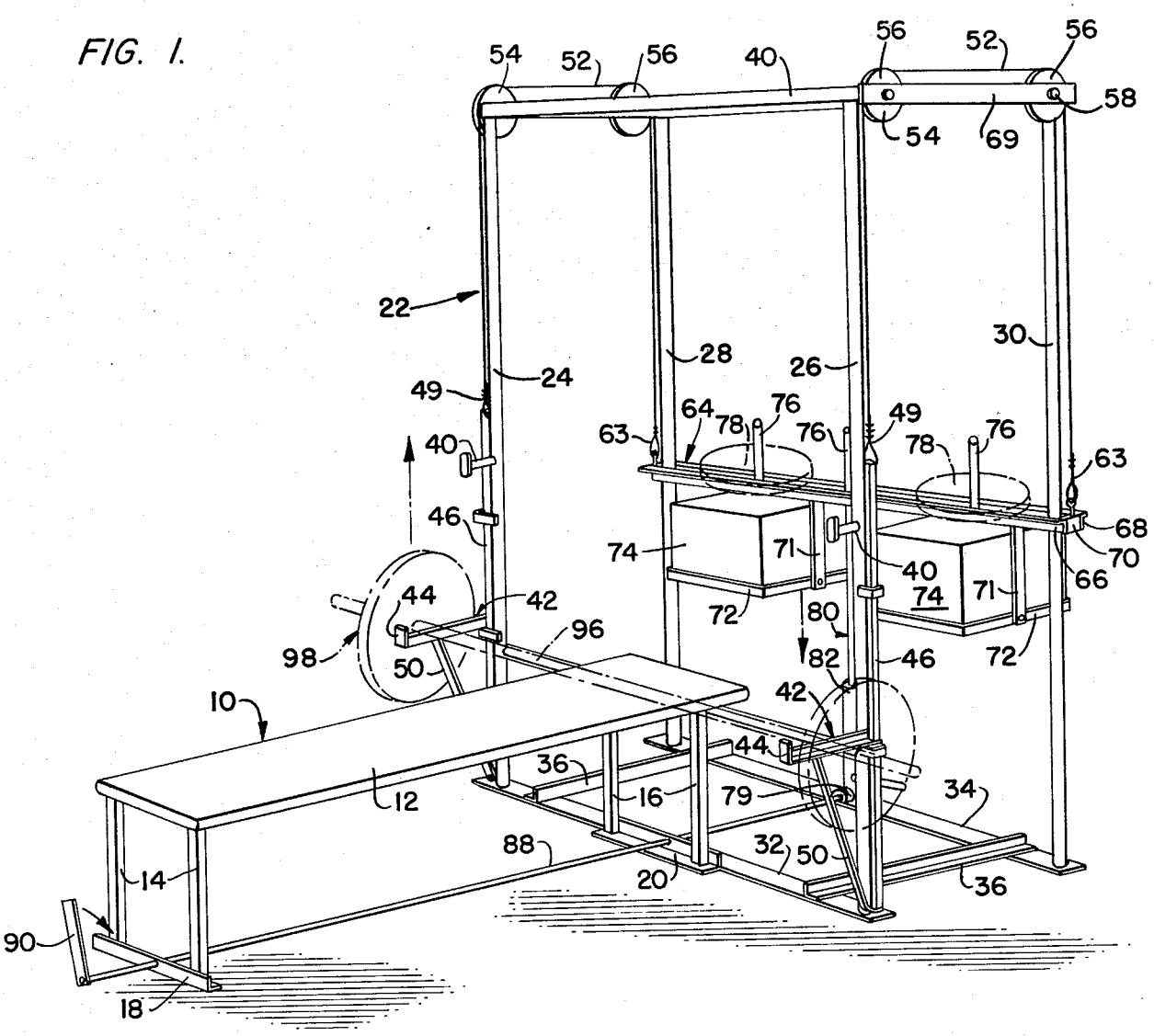
FIG. 1 is a perspective view of a bench for bench press exercises showing the emergency bar bell elevating means of the invention.
Figure 3:
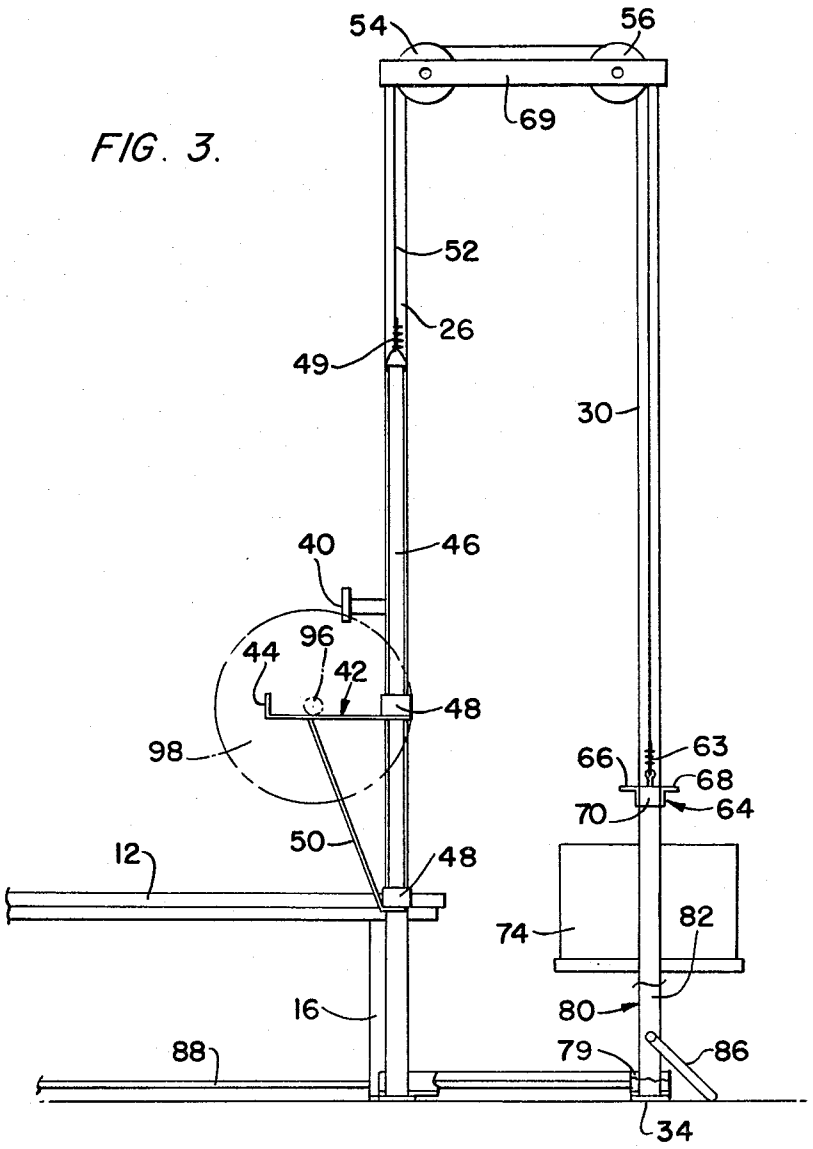
FIG. 3 is similar to FIG. 2 and shows the bar bell elevating means in its raised position.

Referring now to the drawings and particularly FIG. 1, 10 designates a bench for bench pressing, the bench including a horizontal part 12 of usual length for supporting the torso of an exerciser lying on his back on the bench with his feet on the floor. The horizontal part is supported at its front and rear ends on pairs of vertical legs 14, 16, each pair being welded at their lower ends to the horizontal and vertical sides of respective right-angled channels 18, 20.

Figure 5:
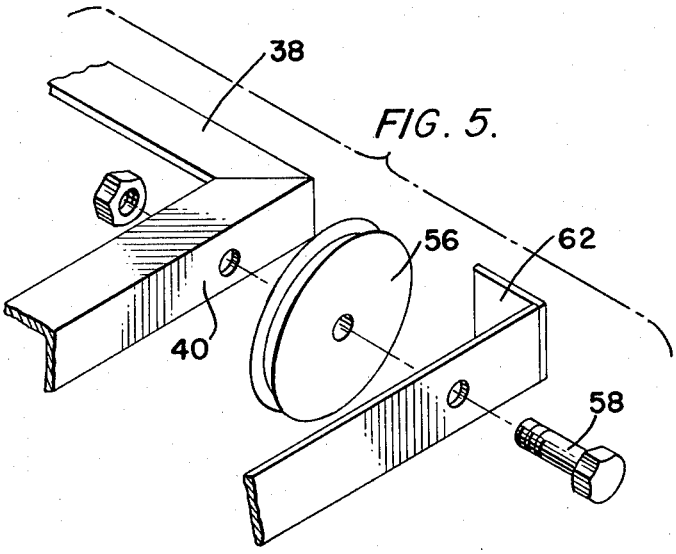
FIG. 5 is an enlarged, exploded view of means for supporting sheaves used with the invention.
Figure 6:
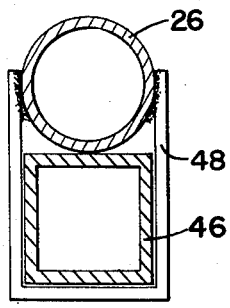
FIG. 6 is an enlarged horizontal cross-sectional view taken on line 6—6 of FIG. 2.

Adjacent the front end of the bench is a vertical frame, broadly designated by the numeral 22 composed of four vertical uprights 24, 26, 28 and 30 which may be pipes of circular cross-section as shown in FIG. 6. The lower ends of the rear uprights 24, 26 are welded to a horizontal strap 26 and and the lower ends of the forward uprights 28, 30 are welded to a horizontal strap 34, the two straps being joined together by welded channel members 36. The upper ends of the uprights are connected together by respective pairs of cross and side channel members 38, 40 (See FIG. 5).

The rear uprights 24, 26 are provided with pairs of welded pegs as indicated by the numeral 40. There may be a series of similar vertically spaced pairs of pegs for the purpose of supporting a bar bell at an elevation suited to the reach of a particular exerciser.

In accordance with the invention, means are provided for automatically elevating a bar bell to a safe distance above the exerciser should he be unable to lift the bar bell onto the support pegs 40, following exercising. With particular reference to FIG. 1, the elevating means comprise a pair of elevatable arms 42 located on opposite sides of the front end of the bench 10. The outer ends of the arms carry upstanding projection 44 and the inner ends of the arms are welded to square or other polygonal rods 46 which are slideably received in vertically spaced, complementary collars 48 welded, as shown in FIG. 6, to opposite sides of the rearward uprights 24, 26. The arms 42 are braced by struts 50 which extend between the undersides of the arms and the lower ends of the slideable square rods 46. The upper ends of the rods 46 are drilled to receive eyes 49 in one end of each of a pair of flexible cables 52 which are trained over pairs of sheaves 54, 56 rotatably mounted at the upper ends of the uprights 24–30 on bolts 58 extending through strap members 69 spanning the uprights 24, 28, and 26, 30 respectively. The ends of the strap members may be welded to the upper part of the frame as by the use of the small gusset plates 62 best seen in FIG. 5.

Eyes 63 at the opposite ends of the cables are connected to the ends of an elevatable carriage 64 composed of a pair of back-to-back channel members 66, 68 embracing the forward uprights 28, 30. The ends of the channel members 66, 68 are welded together by suitable end plates 70 and depending by welded straps 71 from the channels are horizontal frames 72 each supporting a weight 74 which may be any suitable material, such as cast concrete. The weights may be of any value but typically are 100 pounds apiece.

Fixed to the upper sides of the carriage 64 are vertical rods 76, preferably three in number symmetrically arranged along the length of the carriage 64. These rods are adapted to receive weights 78, which are desireably bar bell weights, until the combined loading on the carriage 64 of the weights 74 and weights 78 is in excess by 50 pounds, say, of the weight of the bar bell which the exerciser has selected for a series of bench press exercises.

From the foregoing description, it will be apparent that when the carriage 64 is raised or lowered the arms 42 are moved in the opposite direction through the cables 52. Vertical movement of the carriage 64 may be controlled in a variety of ways, but preferably by means of a hydraulic jack 80 having a cylinder 82 whose lower end is welded or otherwise rigidly fixed to the midpoint of the forward, horizontal, ground engaging strap 34. The jack has a piston rod 84 whose upper end is rigidly connected to the mid-point of the carriage 64. The jack is of conventional construction and is raised through the action of a pump operable by a handle 86 to transfer hydraulic fluid from a reservoir in the base of the jack through the usual check valve (not shown) to the pumping chamber beneath the jack piston. As is conventional, when the jack is to be lowered, the check valve is unseated or a separate relief valve 79 opened by the actuation of lever means under the control of an operator to relieve the hydraulic fluid beneath the jack piston back to the reservoir, the fluid flowing to the reservoir through a restricted orifice so as to dampen the descent of the jack under the influence of a heavy load.

In accordance with the invention, instead of the usual valve lever for unseating the check valve (or opening a separate relief passage) an elongated rod 88 is provided to lead from the valve 79 rearwardly beneath the bench through aligned apertures in the vertical sides of the channel members 18, 20. The rear end of the rod 88 extends slightly beyond the rear end of the bench top 12 and has rigidly fixed thereto an angularly related handle 90 so positioned as to be engageable by some part of a leg of an operator, preferably the foot, though the handle 90 might be cranked to provide a horizontal portion engageable by the exerciser's calf.

In use, the exerciser decides what weight he will press during his exercising period and he satisfies himself that the selected weight will be less by a predetermined amount, say 50 pounds, than the known weight of the two counter weights 74, which weight should be clearly indicated in a prominent place, as by stenciling on the weights. In the event the exerciser's selected press weight is in excess of the counter weights, he adds two equal bar bell weights to the side rods 76 on the carriage 64 until the combined load of the counter weights and bar bell weights exceeds the press weight by 50 pounds. The exerciser may add weights to the central rod 76 instead of to the side rods or he may use all three rods, bearing in mind that the carriage 64 must be symmetrically loaded to guard against the possibility of its tipping and being jammed on the uprights 28, 30.

Figure 2:
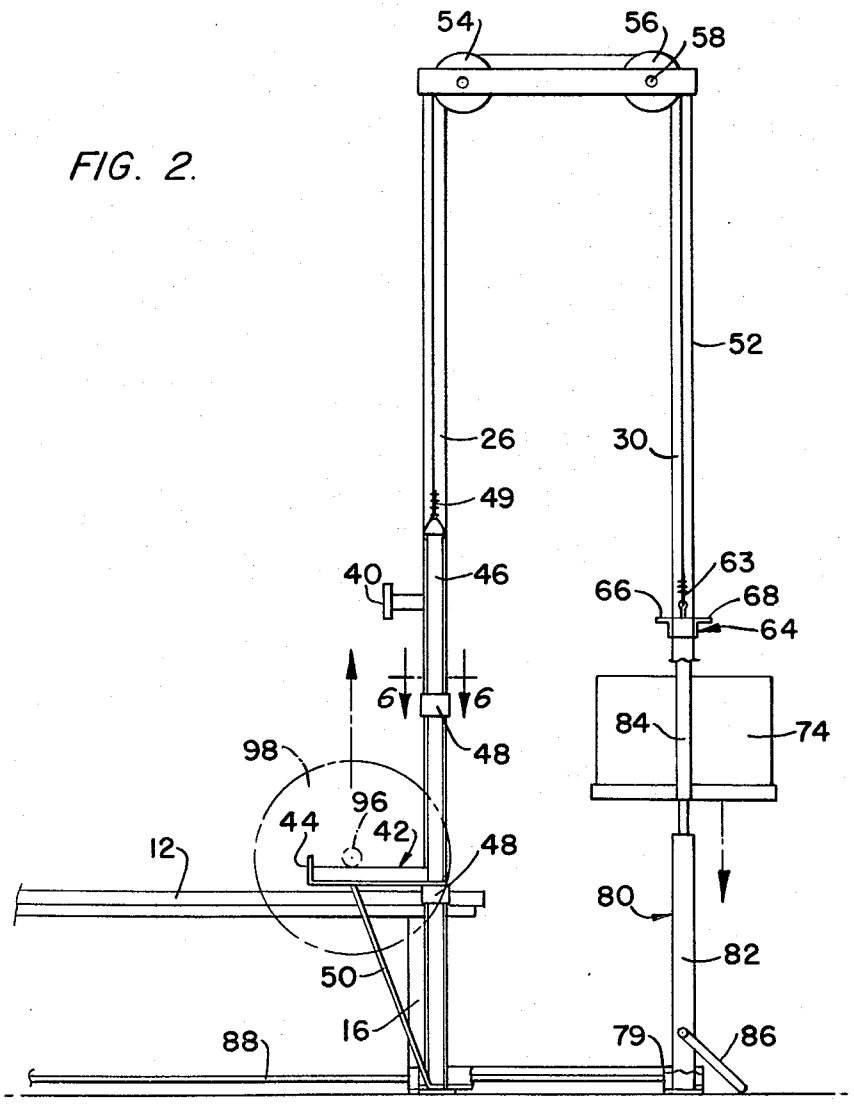
FIG. 2 is a broken side elevational view showing the bar bell elevating means in its lowered position.
Figure 4:
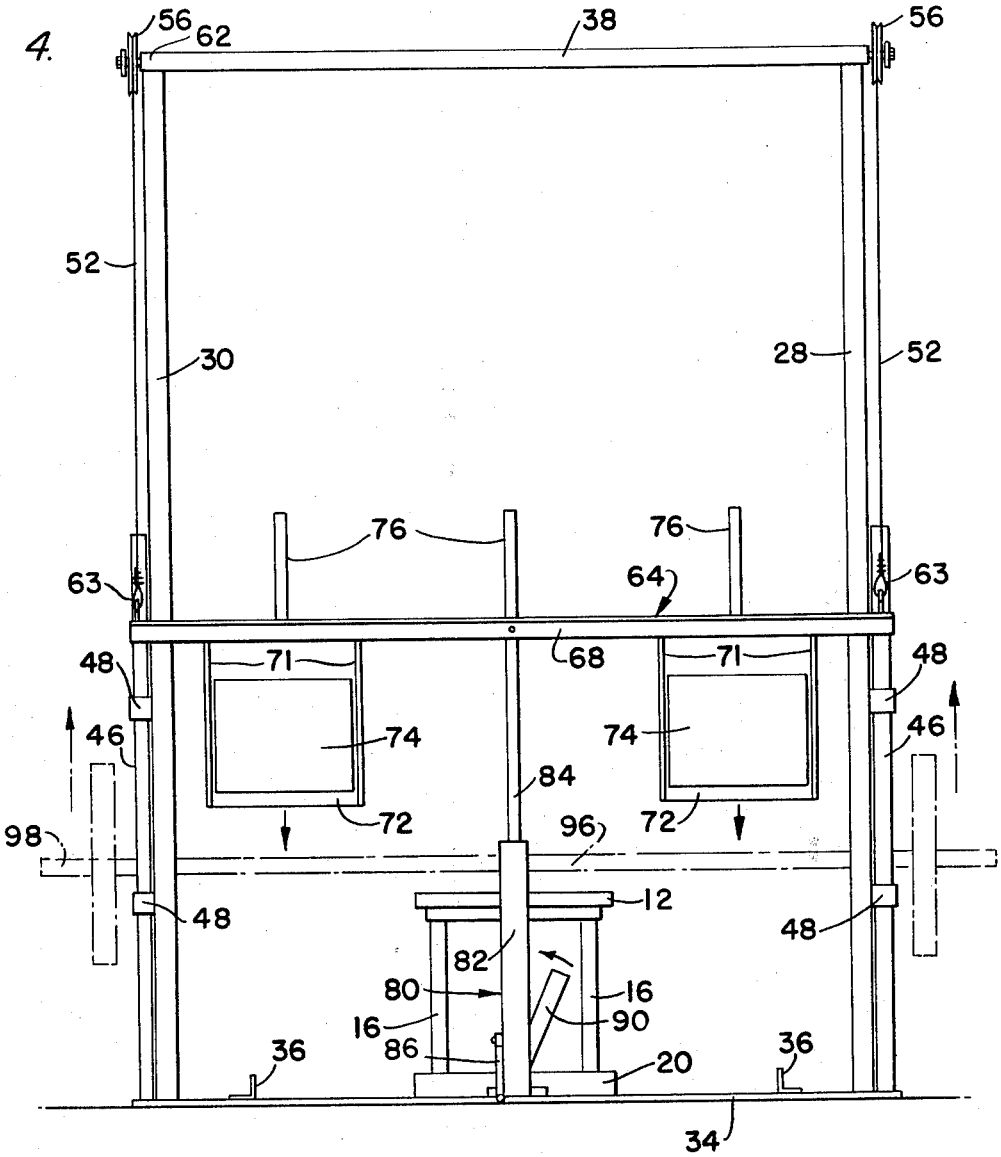
FIG. 4 is a front elevational view of the invention.

After properly balancing the carriage, the exerciser reciprocates the jack handle 86 to raise the piston rod 84 and hence the carriage 64 and the attached counter weights to the positions of FIGS. 1, 2 and 4. As the carriage and weights elevate, the arms 42 descend and the exerciser continues to operate the pump until the arms are sufficiently lowered as to not interfere with exercising.

The exerciser then places the bar bell on the appropriate support pegs 40, takes his position on his back beneath the bar bell, lifts it from the pegs and proceeds to raise and lower the bar bell in the prescribed manner. At the end of the exercise, the exerciser may find that he is unable to raise the bar bell back to the support pegs 40 and, under normal circumstances, he would have to call for help from those nearby to lift the weight and permit him to escape. The present invention eliminates the need for such assistance, which is often embarassing where one is exercising among strangers, by permitting the exerciser himself to control relief of the bar bell weight by merely kicking the handle 90 with his foot or leg to open the jack valve 79 and permit the carriage 64 with the attached weights to descend and elevate in the direction of the arrow 92 the arms 42 which engage under the bar 96 of the bar bell 98 and raise it clear of the exerciser without any further effort being required of him.

Figure 7:
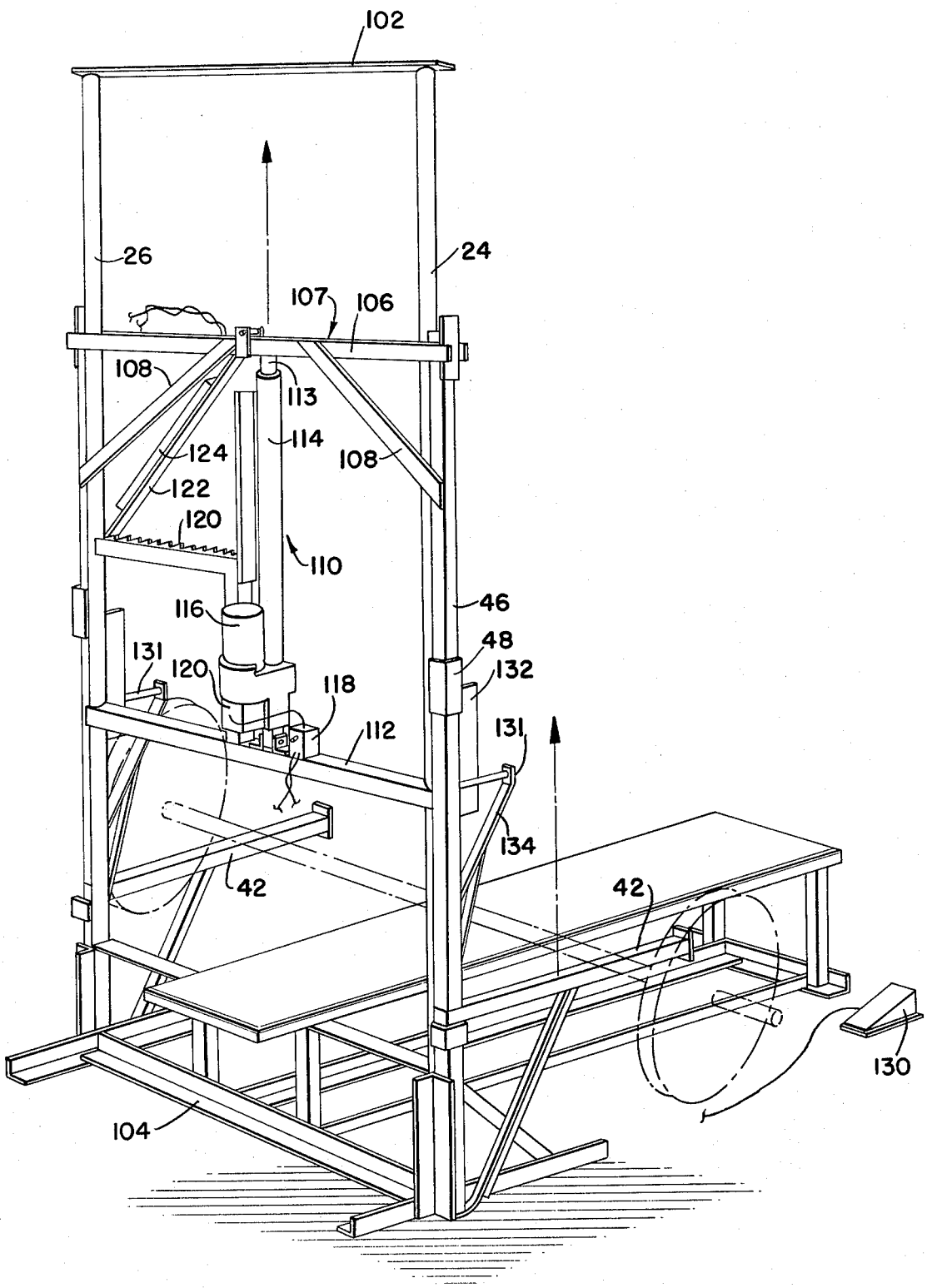
FIG. 7 is a perspective view of a second embodiment of the invention.

With reference now to the embodiment of FIG. 7, wherein like reference numbers refer to like parts of the embodiment of FIGS. 1–6, the moveable arms 42 are carried on square rods 46 slideable in complementary collars 48 welded to circular uprights 24, 26 of a vertical frame which includes upper and lower horizontal members 102, 104. The two slideable square rods 46 are interconnected at their upper ends by a pair of cross members 106, the rods 46 and cross member 106 being rigidly braced into a moveable unitary structure 107 by means of struts 108 welded to the cross member and rods.

The structure 107 carrying the arms 42 is raised or lowered by means of an electrically operated mechanical jack 110 mounted midway between the uprights 24, 26 on a cross beam 112. Though the jack may be any of a variety of known jacks, a suitable jack and the one shown in FIG. 7 is manufactured by Duff & Norton Co., Charlotte, N.C. and sold under the name "Super-Pac Mechanical Actuator, Model No. 6415-18".

Because the jack 110 is known and is not the invention of the present inventor it will be described only in general terms. The jack consists of a rod 113 whose upper end is rigidly connected to the cross member 106 of the structure 107. The rod is slideable within a casing 114 and carries at it lower end a nut (not shown) engaging an internally threaded sleeve (not shown) which is driven through suitable gearing by an electrical motor 116 mounted in the base of the jack.

The motor 116 may be controlled by switch means 118 mounted on the cross beam 112 to drive the threaded sleeve in a direction which retracts the rod 113 and hence lowers the structure 107. The jack includes adjustable limit switch means which are disposed within a housing 120. The limit switch means comprise a pair of switches which are adjustably positioned along a vertical rod in locations corresponding to the maximum extension and retraction of the jack rod 113. The switches are tripped by an actuator which is moved vertically by a nut carried on a secondary threaded shaft which is rotated within the housing 120 by the electric drive motor 116. The movement of the switch actuator nut is proportional to the movement of the main nut carried by the shaft 113 and when the actuator arrives at one of the two switches, the switch is actuated to stop the motor.

The ramp angle of the threads of the sleeve and nut which operate the rod 113 are such that the drive nut cannot spin down the sleeve thread under heavy load regardless of the dimension of the latter. However, as a safety precaution against any possible failure of any component of the jack which would permit the arms to descend under heavy load, as might remotely occur were the nut at the lower end of the rod to become detached from the rod 113, there is provided a ratchet track 120 carried on a rigid horizontal member 121 with which a pawl arm 122 cooperates as more clearly seen in FIG. 8.

Figure 8:
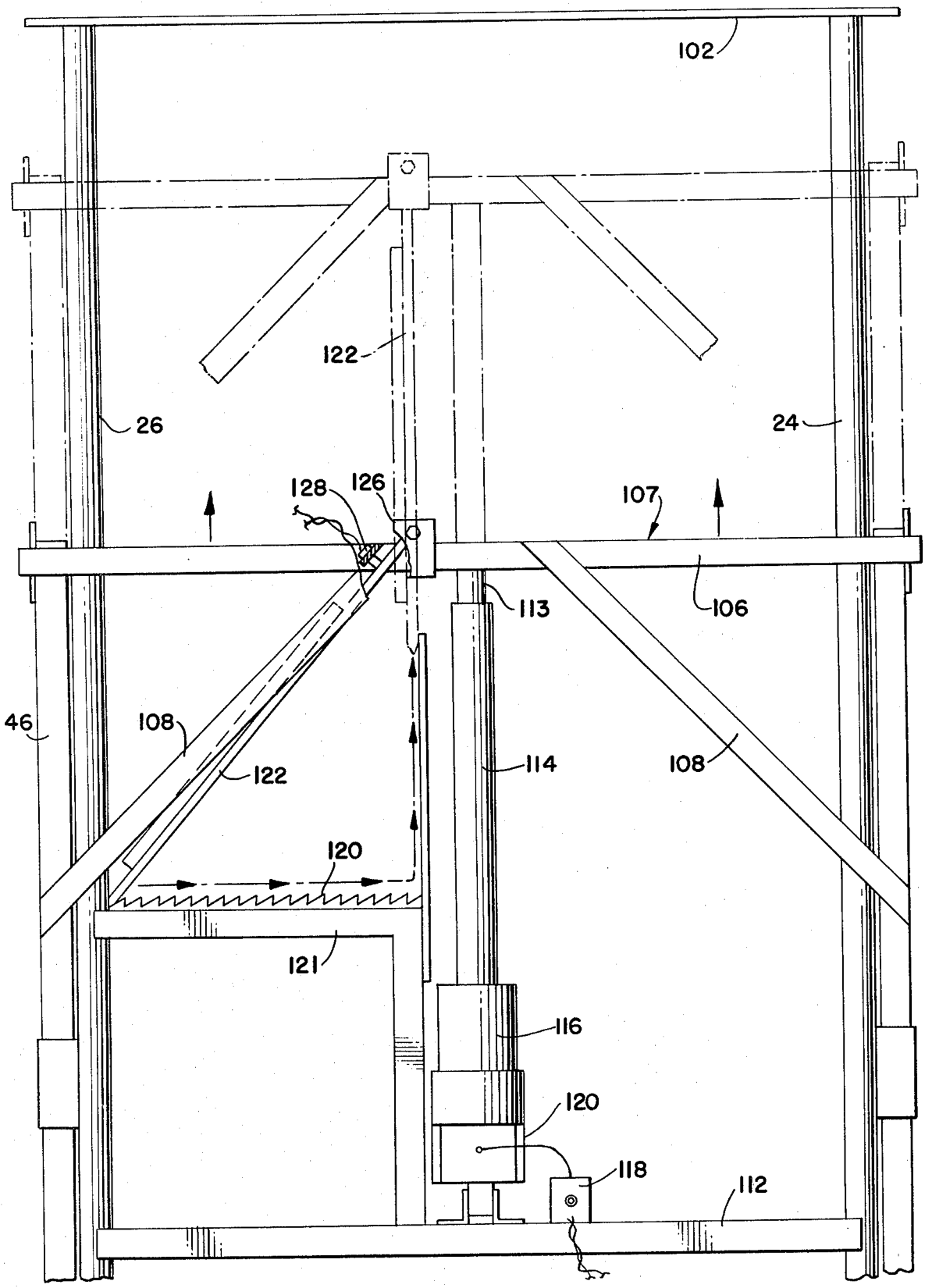
FIG. 8 is an enlarged elevational view of a detail of the embodiment of FIG. 7.

The upper end of the pawl arm 122 is pivoted for swinging between the cross members 106 on a pair of upstanding brackets 126, the arrangement being such that as the structure 107 ascends the arm 122 clicks over the teeth of ratchet 120 until the arm is vertical as shown in phantom lines in FIG. 8. If at anytime during the elevating process the jack rod should descend under gravity the pawl arm 122 will engage a ratchet tooth and arrest the downward movement of the structure 107.

Because the switch 118 is operable to lower the structure 107, it can be seen that if one forgot to manually swing the arm 122 free of the ratchet teeth, the motor, in attempting to lower the structure against the unyielding opposition of the arm, might be quickly burnt out. To prevent this, the invention provides a normally open switch 128 in series with the switch 118. The switch 128 is closed only when one manually swings the arm 122 to the solid line position of FIG. 8 whereupon one can control the lowering of the structure 107 by the switch 128 in the normal way. It will be apparent, of course, that in lieu of the switch 118, lowering of the structure 107 can be controlled exclusively by the switch 128 when the arm is swung to its left-most position in the drawings, it being recalled that the extent of lowering is controlled by the limit switch in the switch housing 120 as above described.

In accordance with the invention, a second foot operated switch 130 is provided which is connected to the jack motor to operate it in a direction to extend the rod 113 when the switch 130 is closed by the foot of an operator.

In use of the embodiment of FIG. 7, if an exerciser, prior to exercising, finds the arm 42 in their elevated position, he swings the arm 122 all the way to the left to close the switch 128 and then operates the switch 118 to rotate the motor in a direction which retracts the rod 113 to lower the structure 107 until the arms 42 are positioned as shown well below the path of movement of a bar bell during exercising. The exerciser need not be unduly concerned about over-shoot since the lower limit switch is automatically operated, as above explained, to stop the motor when the arms have been lowered to their proper position.

The exerciser then places the bar bell 98 on fixed arms 131 welded to rear sides of the uprights 24, 26. Adjacent the front ends of the arms 31 are vertical fins 132 which prevent the bar bell from moving too far forwardly into possible contact with the jack 110 or its controls. The exerciser then positions himself on his back on the bench 10 and reaches up to remove the bar bell from the arms 131. After completing his exercises, should the exerciser be unable to lift the bar back onto the fixed arms 131, he merely presses his foot on the switch 128 which energizes the motor 116 to drive it in a direction to extend the rod 113 and thus raise the structure 107 and arms 42 until they engage the bar bell and relieve the load from the exerciser. As the structure 107 ascends the arm 122 clicks over the ratchet teeth 120 in readiness to prevent accidental descent of the arms 42, with the bar bell engaged thereon, before the exerciser can escape from beneath it.

It will be noted that the fixed arms 131 are provided with rearwardly sloping struts 134. These not only serve as supports for the fixed arms 130 but they also serve to cam the bar bell, while it is being raised, clear of the fixed arms, thus avoiding any tolerance problems whereby the bar bell might strike the underside of the fixed arms before the upper limit switch is actuated to stop the motor.

It will be apparent that the invention is susceptible of modification. For example, instead of the jack pump of the FIGS. 1–6 embodiment being operated by hand, the pump could be driven by a small electric motor. Though cables are shown interconnecting the arm slides 46 and the carriage 64, instead of cables, the hydraulic fluid in the jack 80 might be transferred upon opening of the relief valve to similar jack means operably connected to the arms. Instead of an hydraulic jack, a pawl and ratchet jack might be employed. In the FIGS. 7–8 embodiment a motor operated hydraulic jack might be substituted for the motor operated mechanical jack but the latter is preferred due to the irreversibility of the drive under the weight of the bar bell. Though the foot operated switch or valve is preferred, these might be located where they can be operated by some other part of the exerciser's body.

The invention has been constructed and tested and has been proved to solve the problems and dangers associated with press bench exercising. The invention has particular utility because it permits for the first time press bench exercising by a solitary individual in his home or elsewhere, free of the dangers which, prior to the invention, were inherent in bench pressing by oneself with extremely heavy weights.

Though certain modifications and changes have been described, it will be apparent that the invention is susceptible of a variety of other modifications and changes without departing from the scope and spirit of the appended claims.

What is claimed is:

1. In combination, a bench for supporting an exerciser lying on his back for bench press exercises with a bar bell, said bench having opposed sides and front and rear ends, and means controllable by an exerciser for automatically elevating the bar bell independently of lifting effort by the exerciser; said elevating means comprising a vertical frame adjacent the front end of said bench, vertically moveable arm means carried by said frame and extending in the direction of the rear end of said bench a distance sufficient to intersect the normal path of movement of a bar bell being utilized by an exerciser lying on said bench, power means having an operative connection with said arm means for raising the arm means from a predetermined lowered position wherein the arms are clear of the normal path of movement of a bar bell during exercising to an elevated position clear above the body of an exerciser, control means selectively operable by a body part of an exerciser for effecting operation of said power means to raise said arm means from said lowered position into engagement with a bar bell currently in use by an exerciser, said power means having the capacity to exert an upward force on said arm means which is in excess of a downward force exerted by the weight of a bar bell engaged by said arm means, means for stopping operation of said power means when said arm means arrives at said elevated position, and means for retaining said arm means in said elevated position for at least sufficient time to enable an exerciser to move clear of the path of movement of said arm means.

2. The combination of claim 1 wherein the power means comprises jack means having first and second relatively extensible and retractable parts, one of said parts being connected to said arm means, and the other of said parts being connected to said frame means, relative extension of said jack parts effecting movement of said arm means in one direction, and relative retraction of said jack parts effecting movement of said arm means in a direction opposite to said one direction.

3. The combination of claim 2 wherein said arm means are rigidly connected together to define a moveable unitary structure, said one part of said jack means being directly connected to said unitary structure for direct elevating and lowering of said arm means upon relative extension and retraction, respectively, of said jack parts.

4. The combination of claim 2 wherein said power means includes an electrical motor for operating said jack means.

5. The combination of claim 4 wherein said control means includes a switch accessible to a leg part of an exerciser to effect energization of said electrical motor in a direction which extends said jack means and elevates said arm means.

6. The combination of claim 1 including selectively releasable means for positively preventing said arm means for descending by gravity from substantially any raised position during the course of movement of said arm means from said lowered position towards said elevated position.

7. The combination of claim 6 wherein said prevention means comprises pawl and ratchet means cooperating with said vertical frame and said moveable arms, said pawl and ratchet means being arranged to permit free elevation of said arm means but being engageable to prevent descent of said arm means, said pawl and ratchet means being selectively disengageable to permit the descent of said arm means.

8. The combination of claim 7 wherein said power means includes switch means operable to effect lowering of said arm means, said switch means including a normally open switch which is closed only in response to selective disengagement of said pawl and ratchet means.

* * * * *